US008794166B2

(12) United States Patent
Makover et al.

(10) Patent No.: US 8,794,166 B2
(45) Date of Patent: Aug. 5, 2014

(54) SEWING DIRECTION CONTROL APPARATUS FOR SEWING MACHINE

(75) Inventors: Jakov Makover, Maccabim (IL); Bar Cochva Mardiz, Tel Aviv (IL); Yaacov Sadeh, Rechovot (IL)

(73) Assignee: Orisol Asia Ltd., Chang Hwa (TW)

( * ) Notice: Subject to any disclaimer, the term of this patent is extended or adjusted under 35 U.S.C. 154(b) by 0 days.

(21) Appl. No.: 13/880,049

(22) PCT Filed: Jan. 6, 2012

(86) PCT No.: PCT/CN2012/070101

§ 371 (c)(1),
(2), (4) Date: May 31, 2013

(87) PCT Pub. No.: WO2012/100668

PCT Pub. Date: Aug. 2, 2012

(65) Prior Publication Data

US 2013/0291774 A1 Nov. 7, 2013

(30) Foreign Application Priority Data

Jan. 28, 2011 (CN) ..... 2011 1 0030638

(51) Int. Cl.

| | |
|---|---|
| ***D05B 21/00*** | (2006.01) |
| ***D05B 39/00*** | (2006.01) |
| *D05C 9/04* | (2006.01) |

(52) U.S. Cl.
USPC ..... 112/102.5; 112/103; 112/470.18

(58) Field of Classification Search
USPC ..... 112/102.5, 470.06, 470.13, 470.18, 112/220, 103
See application file for complete search history.

(56) References Cited

U.S. PATENT DOCUMENTS

| | | | | |
|---|---|---|---|---|
| 437,439 | A * | 9/1890 | Lefeber | 112/118 |
| 3,082,721 | A * | 3/1963 | Bono | 112/102 |
| 3,750,186 | A * | 7/1973 | Sakamoto | 346/33 MC |
| 4,419,945 | A * | 12/1983 | Nishina | 112/103 |
| 4,735,159 | A * | 4/1988 | van Brussel et al. | 112/470.04 |
| 5,503,093 | A * | 4/1996 | Katou | 112/103 |

* cited by examiner

*Primary Examiner* — Ismael Izaguirre
(74) *Attorney, Agent, or Firm* — Banger Shia

(57) ABSTRACT

A sewing direction control apparatus for sewing machine, comprising: a base plate (10), a circular ring-shaped transmission element (20) dispose on the base plate (10) and a driving element (50) with a driving unit (52). During sewing, the driving unit (52) drives the transmission element (20), rotating a sewing product (A) placed at the center of the transmission element (20) with the driving element (52), thereby controlling the sewing direction of the sewing product (A), and thus improving the sewing accuracy. The direction control apparatus has low cost, and is suitable for various types of automatic sewing machines.

6 Claims, 6 Drawing Sheets

SEWING DIRECTION CONTROL APPARATUS FOR SEWING MACHINE

BACKGROUND OF THE INVENTION

1. Field of the Invention

The present invention relates to an automatic sewing machine, and more particularly to a sewing direction control apparatus for sewing machine.

2. Description of the Prior Art

Computer control sewing machines are usually used to embroider complicated patterns automatically rather than manually, whereby to enhance the quality of the embroidery pattern, or used to stitch buttons or create decorative patterns on sewing products, whereby to improve sewing speed or accuracy. The existing computer control sewing machine essentially comprises a clamp on a work platform to clamp and fix the sewing product to be embroidered, the clamp is driven by a movement device to perform two-dimensional movement on the work platform with respect to the sewing head of the sewing machine, and the sewing product will move along with the clamp, so that patterns can be embroidered on the sewing product.

The sewing head of the existing computer control sewing machines is designed to be able to sew the sewing product only in a specific direction, so that the sewing product has to be inserted from the specific direction into the sewing head and should be aligned to the needle, then the sewing thread above the sewing machine can be formed into a loop to form lock stitch seam by cooperating with the sewing thread from the thread spool which is at the lower portion of the sewing machine. However, when moving in a two-dimensional manner along the work platform, the sewing product might approach the needle from any direction, resulting in poor stitching or deviation of sewing thread.

To solve the above defects, U.S. Pat. No. 4,498,404 discloses an automatic sewing apparatus which uses a manipulator arm to replace the conventional 2D movement device. The manipulator arm includes three rotation axes, so that the sewing product can be better controlled by the manipulator arm to rotate between the needle and the work platform, ensuring that the sewing product is kept being inserted into the sewing head from a specific direction. An Italian patent B093A 000113 discloses another sewing apparatus, wherein a lever with a needle is arranged above the needle plate of the sewing head, and below the needle plate is disposed a thread shaft with a hook. The lever and the thread shaft rotate together to maintain the relative position between the needle and the hook unchanged, ensuring that the sewing product is kept being inserted into the sewing head from a specific direction.

However, the above two sewing apparatuses still have the following disadvantages:

1, for automatic sewing machines, the sewing product must be moved intermittently and rapidly a very small distance at a time during sewing operation, so that the manipulator arm for moving the sewing product should have excellent acceleration ability and should be capable of precisely controlling the distance that the sewing product moves, resulting in a high manufacturing and maintenance cost of the manipulator arm.

2, there are various types of automatic sewing machines, however, the positioning device which maintains the relative position between the needle and the hook unchanged by using the synchronous rotation of the lever and the thread shaft is inapplicable to the sewing machines with cylinder bed head. Therefore, it is still unable to solve the sewing direction problem.

The present invention has arisen to mitigate and/or obviate the afore-described disadvantages.

SUMMARY OF THE INVENTION

The primary objective of the present invention is to provide a low cost sewing direction control apparatus for sewing machine which provides accurate sewing operation and is suitable for use in various automatic sewing machines.

To achieve the above objective, a sewing direction control apparatus for sewing machine in accordance with the present invention comprises:

a base plate;

a transmission element being a circular ring-shaped structure mounted on the base plate and centrally provided with a circular cavity, a sewing product being fixed at a bottom of the cavity and located corresponding to the needle;

a driving element including a servo motor connected to a driving shaft, and a disc-shaped driving unit connected to an end of the driving shaft, the end of the driving shaft being connected to a center of the driving unit, the driving unit is located at a periphery of and connected to the transmission element, the servo motor driving the driving unit to rotate and consequently rotating the transmission element and the sewing product, a sewing direction of the needle being tangent to a rotation direction of the sewing product.

The sewing direction control apparatus for sewing machine in accordance with the present invention uses teeth engagement to perform highly accurate, intermittent and fast movement, therefore, the direction control apparatus of the present invention has low cost, and is suitable for various types of automatic sewing machines.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
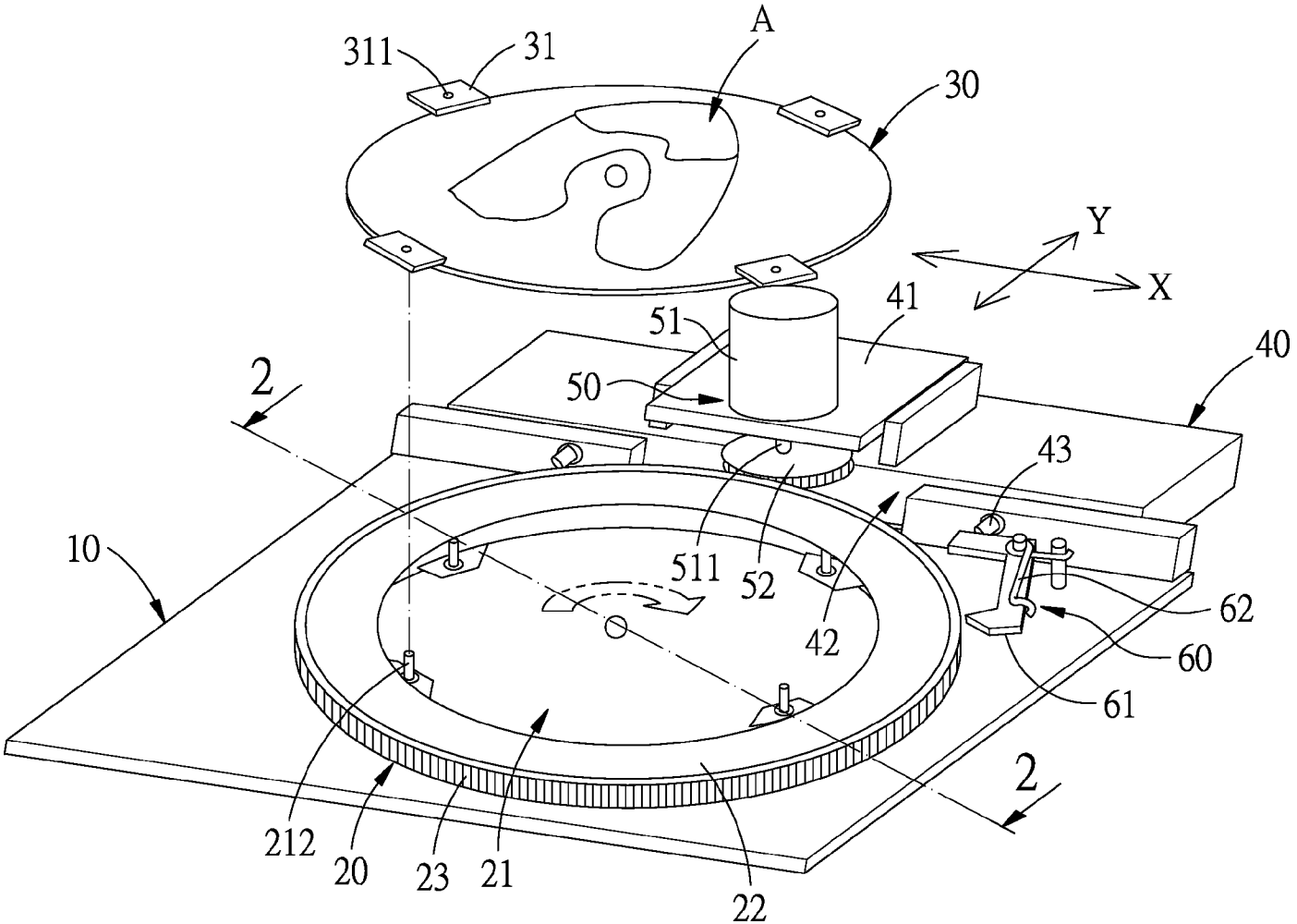
FIG. 1 is a perspective view of a sewing direction control apparatus for sewing machine in accordance with a preferred embodiment of the present invention.
Figure 2:
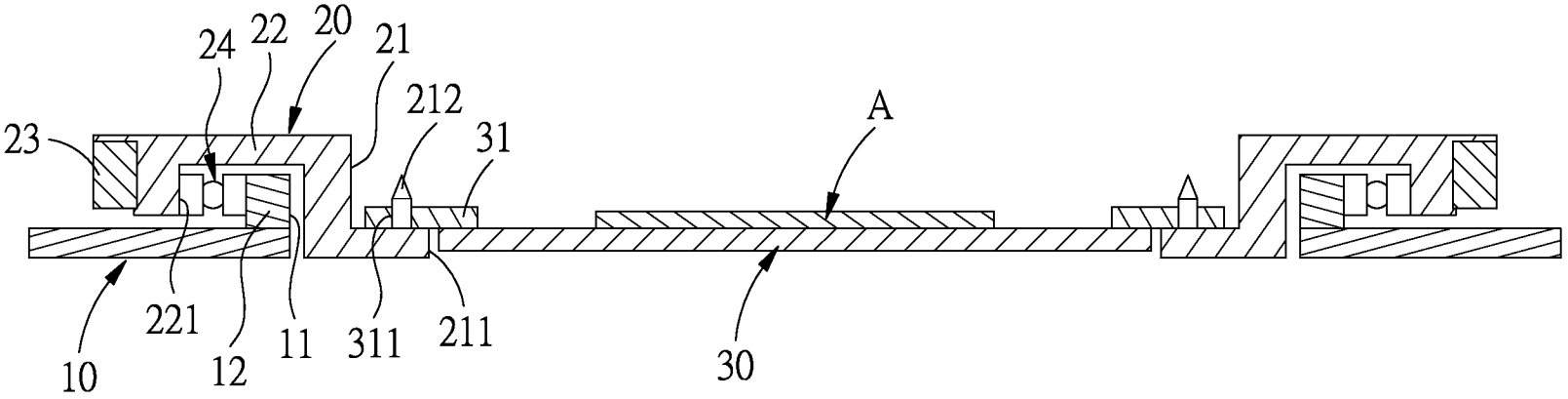
FIG. 2 is a cross sectional view of the sewing direction control apparatus for sewing machine in accordance with the preferred embodiment of the present invention.

Referring to FIGS. 1 and 2, a sewing direction control apparatus for sewing machine in accordance with a preferred embodiment of the present invention comprises a base plate 10, a transmission element 20 disposed on the base plate 10, a sewing plate 30 disposed in the transmission element 20 to fix a sewing product A, and a slide rack 40 and a driving element 50 disposed at one side of the base plate 10.

The base plate 10 is rectangular and centrally provided with a hole 11 and a flange 12 around the hole 11. The base plate 10 is an X-Y planar surface with an X direction and a Y direction. In this embodiment, as shown in FIG. 1, the base plate 10 is further provided with two protrusions 13 which are located adjacent to the hole 11 an a corner of the base plate 10.

The transmission element 20 is a circular ring-shaped structure located around the hole 11 of the base plate 10. As shown in FIG. 2, the transmission element 20 is centrally provided with a circular cavity 21, an annular slot 211 around the bottom of the circular cavity 21, and a plurality of positioning pins 212 disposed at the bottom of the cavity 21 and located around the bottom of the annular slot 211. An annular engaging portion 22 extending outward from the bottom of the cavity 21 is formed with an annular groove 221 which is located around the periphery of the transmission element 20. The annular groove 221 and the cavity 21 open in opposite directions and separated from each other by the wall of the cavity 21. The transmission element 20 is provided with a threaded surface 23 around the outer peripheral surface of the annular engaging portion 22. The annular groove 221 of the transmission element 20 is located corresponding to the flange 12 of the base plate 10, namely, the flange 12 is received in the annular groove 221, and an annular bearing 24 is disposed between the flange 12 and the annular groove 221 to enable the transmission element 20 to rotate with respect to the flange 12. In this embodiment, the transmission element 20 is provided with four spaced positioning pins 212.

The sewing plate 30 is a circular structure received in the cavity 21 of the transmission element 20 and provided with a plurality of ears 31 around a periphery thereof. The ears 31 each have a pivot hole 311 and are located corresponding to the positioning pins 212 of the transmission element 20 in such a manner that the positioning pins 212 of the transmission element 20 are inserted in the pivot holes 311 of the sewing plate 30, so as to fix the sewing plate 30 to the annular slot 211 of the transmission element 20. In this embodiment, the sewing plate 30 is provided with four spaced ears 31 to cooperate with the positioning pins 212.

The slide rack 40, as shown in FIG. 1, is disposed on the X-Y surface and fixed at one side of the base plate 10 which is perpendicular to the direction Y. The slide rack 40 a rectangular structure which is centrally provided at a top surface thereof with a rack plate 41 which is located higher than the X-Y surface. The slide rack 40 is provided with an abutting protrusion 43 at one side thereof adjacent the base plate 10, the abutting protrusion 43 is located corresponding to the protrusions 13 of the base plate 10 and extends in the direction Y. the slide rack 40 is further provided with a passage 42 corresponding to the rack plate 41. In this embodiment, the slide rack 40 is driven by a linear movement device (not shown) to move linearly along the direction Y of the X-Y surface, so as to move close to or away from the base plate 10.

The driving element 50, as shown in FIG. 1, is mounted on the slide rack 40 and comprises a servo motor 51 disposed on the rack plate 41, a driving shaft 511 located below the servo motor 51 and inserted in the rack plate 41, and a driving unit 52 connected to one end of the driving shaft 511. The driving unit 52 is a disc structure. In this embodiment, around the outer peripheral surface of the driving unit 52 is formed a threaded surface, and the end of the driving shaft 511 is connected to the center of the driving unit 52. The driving unit 52 is located on the X-Y surface and extends out of the passage 42 of the slide rack 40 to mate with the threaded surface 23 of the transmission element 20.

Figure 3B:
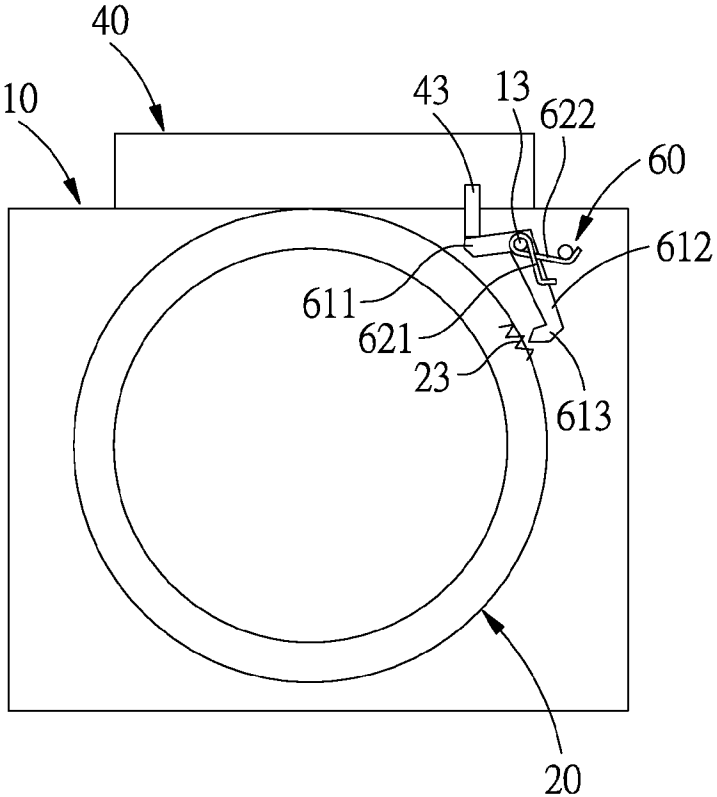
FIG. 3B is an operational view showing that the slide rack of the present invention is engaged with the base plate.
Figure 3A:
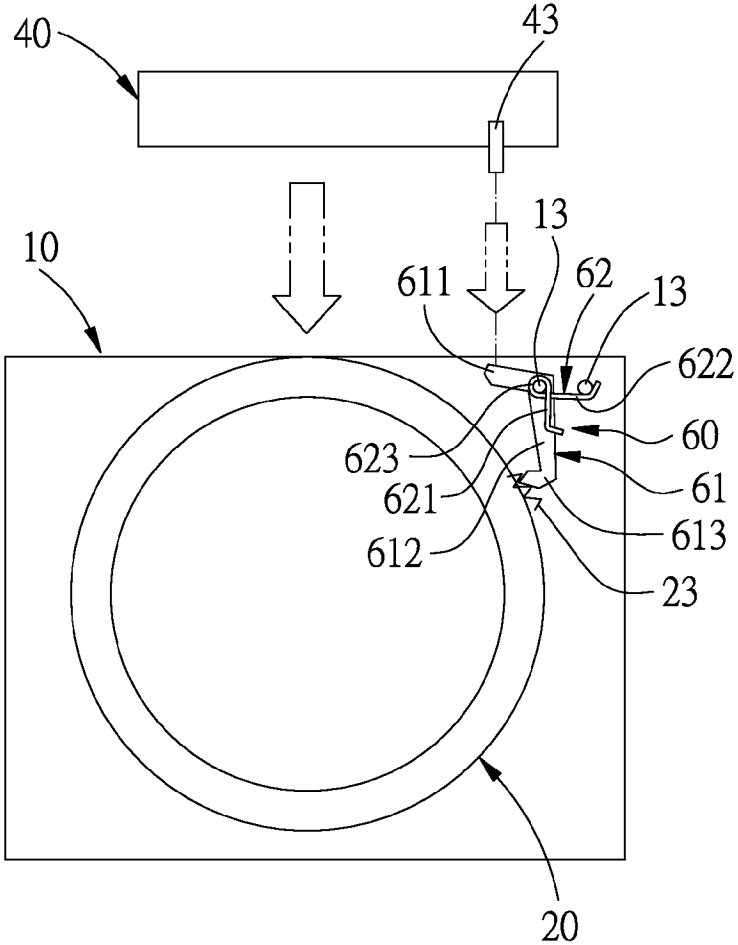
FIG. 3A is an operational view showing that the slide rack of the present invention moves away from the base plate.

A control element 60, as shown in FIGS. 1, 3A, 3B, is pivoted to the two protrusions 13 of the base plate 10 and comprises a control unit 61 and an elastic unit 62. The control unit 61 is reversed U-shaped and includes an operating section 611, a connecting section 612 and an engaging section 613. A conjunction between the operating section 611 and the connecting section 612 is pivoted to one of the protrusions 13 adjacent the transmission element 20, so that the operating section 611 and the engaging section 613 approximately extend in the direction X and toward the transmission element 20, and the free end of the engaging section 613 is a threaded structure. The elastic unit 62 is approximately L-shaped and includes a stationary section 621 and an abutting section 622. A connecting hole 623 is formed at the conjunction between the stationary section 621 and the abutting section 622 to enable the elastic unit 62 to be pivoted to the one of the protrusions 13 adjacent the transmission element 20 in such a manner that the end of the stationary section 621 of the elastic unit 62 is pressed against another one of the protrusions 13 which is located farther away from the transmission element 20, and the end of the abutting section 622 is pressed against the connecting section 612 of the control unit 61.

As shown in FIG. 3A, when the base plate 10 moves away from the slide rack 40, the connecting section 612 of the control unit 61 will be pushed by the abutting section 622 of the elastic unit 62, the engaging section 613 of the control unit 61 will be engaged with the threaded surface 23 of the transmission element 20, and the driving unit 52 of the driving element 50 will be disengaged from the transmission element 20 to enable the transmission element 20 to be engaged with and fixed by the control unit 61. As shown in FIG. 3B, when the base plate 10 move toward the slide rack 40, the operating section 611 of the control unit 61 will be pushed by the abutting protrusion 43 of the slide rack 40, so that the engaging section 613 of the control unit 61 will be disengaged from the threaded surface 24 of the transmission element 20, and the driving unit 52 of the driving element 50 will be engaged with the threaded surface 24 of the transmission element 20 to enable the transmission element 20 to be rotated by the driving unit 52.

The abovementioned are the structural relations of the main components of the first preferred embodiment. It is to be noted that the present invention also provides another embodiment; its structure is explained as follows.

Figure 4:
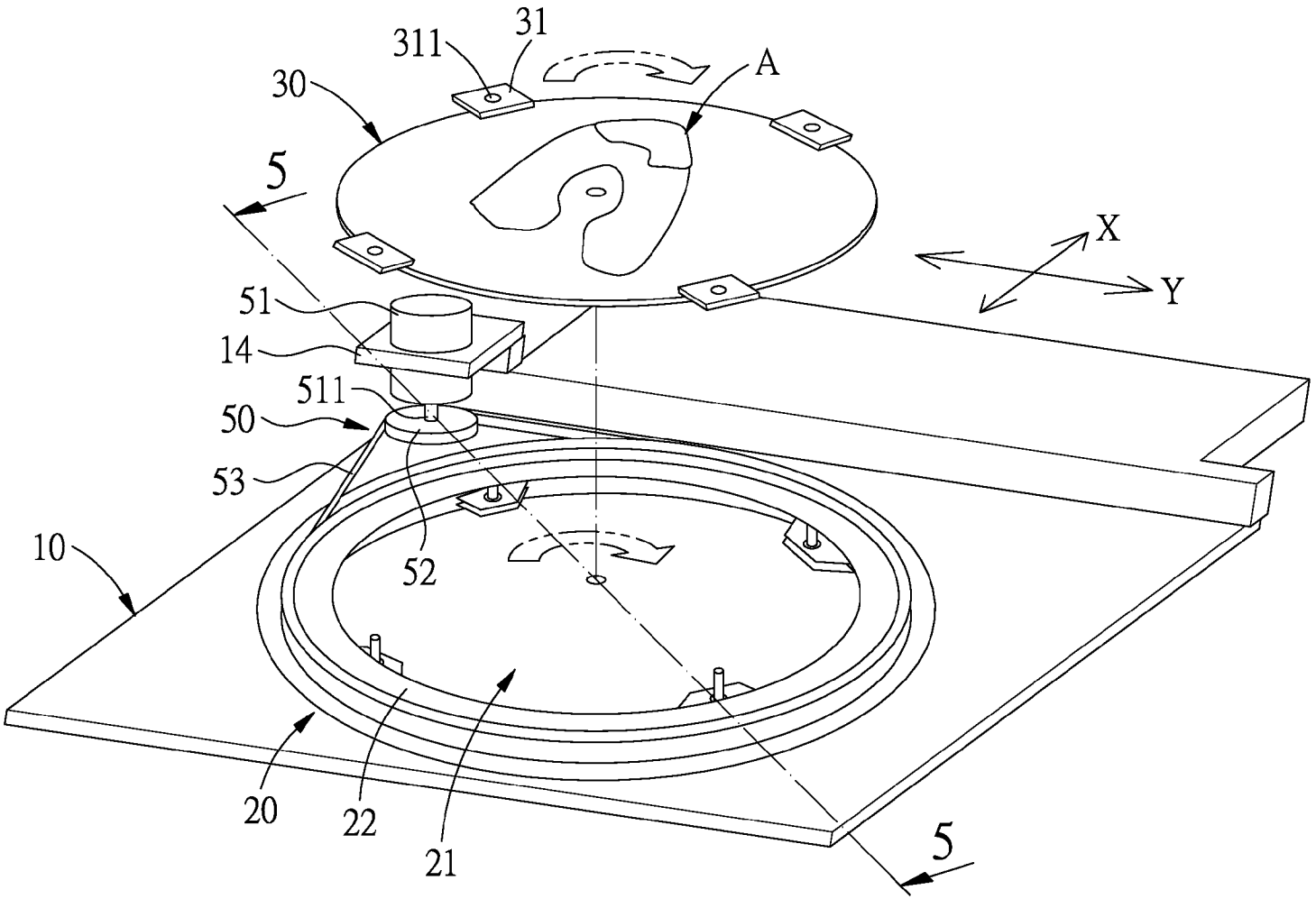
FIG. 4 is a perspective view of a sewing direction control apparatus for sewing machine in accordance with another preferred embodiment of the present invention.
Figure 5:
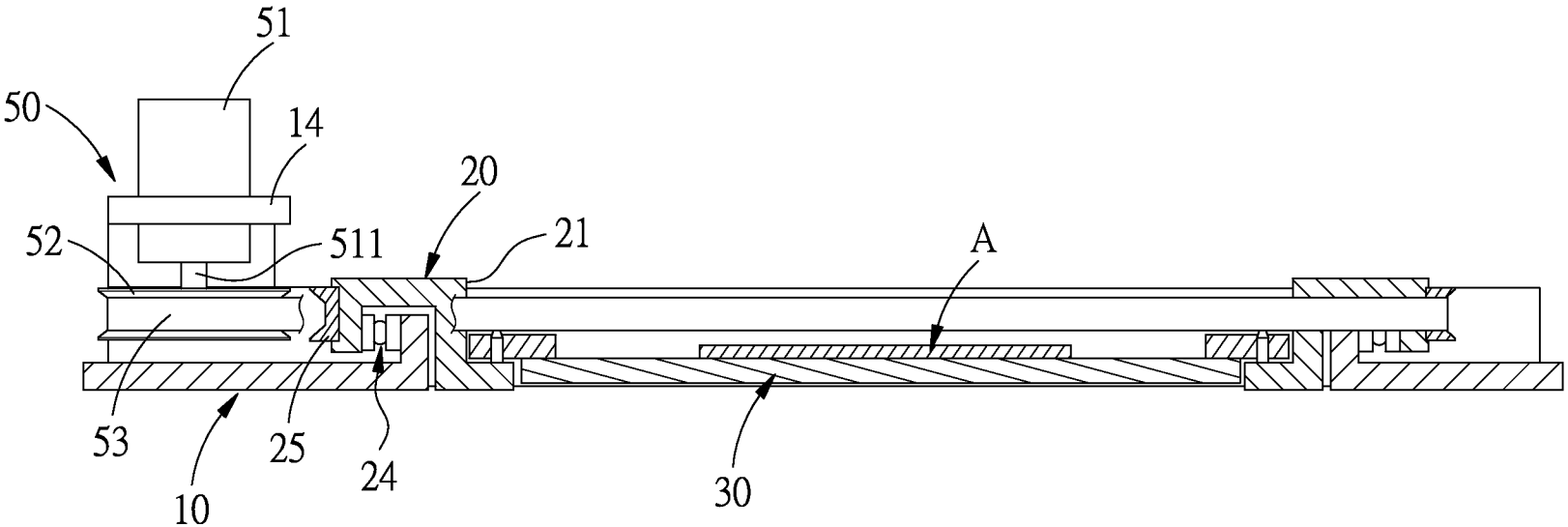
FIG. 5 is a cross sectional view of the sewing direction control apparatus for sewing machine in accordance with the another preferred embodiment of the present invention.

Referring to FIGS. 4 and 5, in this embodiment, around an outer peripheral surface of the annular engaging portion 22 of the transmission element 20 is provided a driven belt 25, and a driving belt 53 winds around the driven belt 25 and the driving unit 52 of the driving element 50 to rotate the transmission element 20. At a corner of the base plate 10 is disposed a pallet 14 which is higher than the X-Y surface. The servo motor 51 of the driving element 50 is inserted in the pallet 14, the driving shaft 511 of the servo motor 51 is connected to the driving unit 52, the driven belt 25 of the transmission element 20 located toward the driving unit 52, and the driving belt 53 winds around the driven belt 25 and the driving unit 52 of the driving element 50. When the servo motor 51 rotates the driving unit 52, the driving unit 52 will drive the transmission element 20 to rotate on the base plate 10 via the driving belt 53. In this embodiment, the driven belt 25 and the driving belt 53 are timing belts, which are engaged with each other via teeth engagement.

Figure 6:
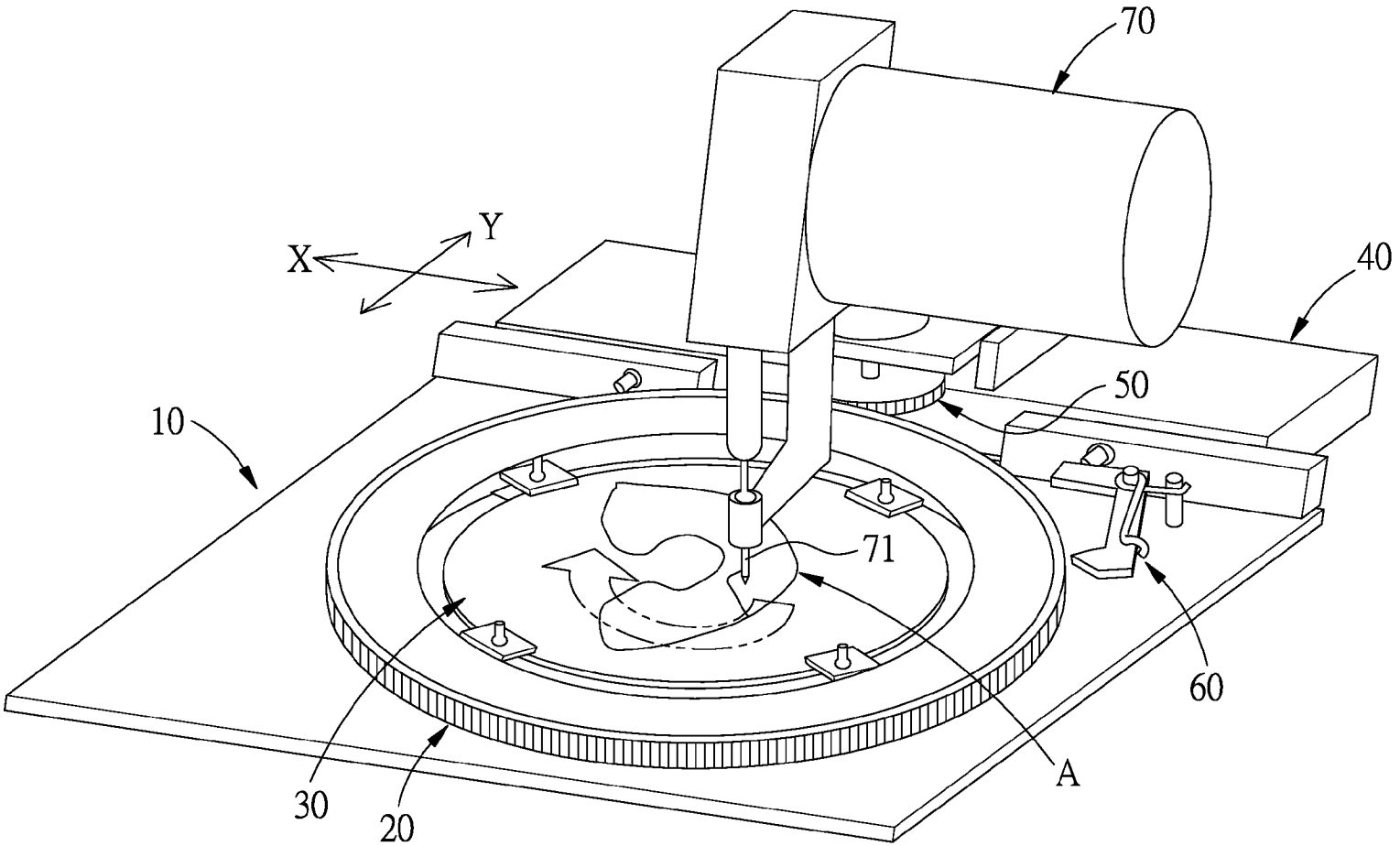
FIG. 6 is an operational view of the sewing direction control apparatus for sewing machine in accordance with the another preferred embodiment of the present invention.

FIG. 6 shows that the sewing direction control apparatus for sewing machine in accordance with the present invention is used in combination with a needle 71 of a sewing head 70.

As shown in FIG. 6, when the slide rack 40 moves toward the base plate 10, the sewing product A is fixed on the sewing plate 30 and located corresponding to the needle 71 of the sewing head 70, and the preset sewing path of the needle 71 extends along the direction Y. The transmission element 20 is rotated by the driving element 50. Meanwhile, the sewing product A is caused to rotate clockwise, so that the sewing direction is maintained tangent to the rotation direction of the sewing product A, thus fixing the sewing direction of the sewing machine, making the sewing machine perform sewing operation by moving along the desired sewing direction, and consequently improving the sewing speed and quality. Furthermore, the sewing direction control apparatus for sewing machine in accordance with the present invention uses teeth engagement to perform highly accurate, intermittent and fast movement, therefore, the direction control apparatus of the present invention has low cost, and is suitable for various types of automatic sewing machines.

While we have shown and described various embodiments in accordance with the present invention, it is clear to those skilled in the art that further embodiments may be made without departing from the scope of the present invention.

What is claimed is:

1. A sewing direction control apparatus for sewing machine, the sew machine being provided with a needle, the sewing direction control apparatus comprising:

a base plate;

a transmission element being a circular ring-shaped structure mounted on the base plate and centrally provided with a circular cavity, a sewing product being fixed at a bottom of the cavity and located corresponding to the needle;

a driving element including a servo motor connected to a driving shaft, and a disc-shaped driving unit connected to an end of the driving shaft, the end of the driving shaft being connected to a center of the driving unit, the driving unit is located at a periphery of and connected to the transmission element, the servo motor driving the driving unit to rotate and consequently rotating the transmission element and the sewing product, a sewing direction of the needle being tangent to a rotation direction of the sewing product;

wherein the transmission element is provided with a slot around the bottom of the circular cavity, and a plurality of positioning pins disposed at the bottom of the cavity and located around the bottom of the slot, a sewing plate is received in the slot and provided with a plurality of ears around a periphery thereof, the positioning pins of the transmission element are inserted in the ears of the sewing plate, so as to fix the sewing plate.

2. The sewing direction control apparatus for sewing machine as claimed in claim 1, wherein the base plate is rectangular and centrally provided with a hole and a flange around the hole, the transmission element is provide with an annular engaging portion extending outward from the bottom of the cavity, the annular engaging portion is formed with an annular groove which is located around the periphery of the transmission element, the annular groove and the cavity open in opposite directions, the transmission element is provided with a threaded surface around an outer peripheral surface of the annular engaging portion, the annular groove of the transmission element is located corresponding to the flange of the base plate, the flange is received in the annular groove, and an annular bearing is disposed between the flange and the annular groove to enable the transmission element to rotate with respect to the flange.

3. The sewing direction control apparatus for sewing machine as claimed in claim 1, wherein the transmission element is provided with a threaded surface around the outer peripheral surface thereof, the driving element is mounted on a slide rack which is centrally provided at a top surface thereof with a rack plate and an abutting protrusion at one side thereof adjacent the base plate, the slide rack is further provided with a passage corresponding to the rack plate, the servo motor is disposed on the rack plate and the driving shaft is inserted through the rack plate to connect the driving unit, around an outer peripheral surface of the driving unit is formed a threaded surface, the driving unit extends out of the passage of the slide rack to mate with the threaded surface of the transmission element.

4. The sewing direction control apparatus for sewing machine as claimed in claim 3, wherein the base plate is further provided with a control element and two protrusions which are located corresponding to the abutting protrusion of the slide rack, the control element comprises a control unit and an elastic unit, the control unit includes an operating section, a connecting section and an engaging section, a conjunction between the operating section and the connecting section is pivoted to one of the protrusions adjacent the transmission element, the operating section and the engaging section extend toward the transmission element, and a free end of the engaging section is a threaded structure, the elastic unit is L-shaped and includes a stationary section and an abutting section, a connecting hole is formed at a conjunction between the stationary section and the abutting section to enable the elastic unit to be pivoted to the one of the protrusions adjacent the transmission element in such a manner that the end of the stationary section of the elastic unit is pressed against another one of the protrusions which is located farther away from the transmission element, and the end of the abutting section is pressed against the connecting section of the control unit, when the base plate moves away from the slide rack, the connecting section of the control unit is pushed by the abutting section of the elastic unit, the engaging section of the control unit is engaged with the threaded surface of the transmission element, so that the transmission element is engaged with and fixed by the control unit, when the base plate moves toward the slide rack, the operating section of the control unit is pushed by the abutting protrusion of the slide rack, so that the engaging section of the control unit is disengaged from the threaded surface of the transmission element.

5. The sewing direction control apparatus for sewing machine as claimed in claim 3, wherein the slide rack is driven by a linear movement device to move close to or away from the base plate.

6. The sewing direction control apparatus for sewing machine as claimed in claim 1, wherein the base plate is provided with a pallet, around an outer peripheral surface of the transmission element is provided a driven belt, the servo motor of the driving element is fixed on the pallet, the driven belt of the transmission element located toward the driving unit, and the driven belt winds around the driven belt and the driving unit of the driving element, when the servo motor rotates the driving unit, the driving unit will drive the transmission element to rotate on the base plate via the driving belt.

* * * * *